US009540203B2

(12) United States Patent
Kracht

(10) Patent No.: US 9,540,203 B2
(45) Date of Patent: Jan. 10, 2017

(54) METHOD AND SYSTEM FOR SYNCHRONIZING ITEMS USING POSITION COMPENSATION

(71) Applicant: BELL AND HOWELL, LLC., Durham, NC (US)

(72) Inventor: Aaron A. Kracht, Raleigh, NC (US)

(73) Assignee: Bell and Howell, LLC, Durham, NC (US)

( * ) Notice: Subject to any disclaimer, the term of this patent is extended or adjusted under 35 U.S.C. 154(b) by 74 days.

(21) Appl. No.: 14/529,053

(22) Filed: Oct. 30, 2014

(65) Prior Publication Data

US 2015/0130126 A1 May 14, 2015

Related U.S. Application Data

(60) Provisional application No. 61/903,734, filed on Nov. 13, 2013.

(51) Int. Cl.
*B65H 29/12* (2006.01)
*B65H 39/06* (2006.01)
(Continued)

(52) U.S. Cl.
CPC ..... *B65H 29/12* (2013.01); *B65H 39/06* (2013.01); *B65H 29/125* (2013.01); *B65H 29/52* (2013.01); *B65H 43/02* (2013.01); *B65H 2301/3121* (2013.01); *B65H 2301/3423* (2013.01); *B65H 2301/351* (2013.01); *B65H 2301/4452* (2013.01); *B65H 2301/4454* (2013.01); *B65H 2301/44512* (2013.01);
(Continued)

(58) Field of Classification Search
CPC . B65H 29/12; B65H 39/06; B65H 2301/4452; B65H 2301/44522; B65H 2301/351; B65H 2301/4447; B65H 2301/445; B65H 2301/44512
See application file for complete search history.

(56) References Cited

U.S. PATENT DOCUMENTS 5,235,883 A * 8/1993 Jeske ..... B07C 5/36 271/303
6,435,331 B1 * 8/2002 Olson ..... B65G 43/08 198/357
(Continued)

FOREIGN PATENT DOCUMENTS

EP 2876069 B1 9/2016

OTHER PUBLICATIONS

European Search Report for Application No. EP 14192784 dated Apr. 20, 2015.
(Continued)

*Primary Examiner* — Michael McCullough
(74) *Attorney, Agent, or Firm* — Jenkins, Wilson, Taylor & Hunt, P.A.

(57) ABSTRACT

The present applications relates to techniques and equipment to control the alignment of cut sheets of paper that are transported in parallel in an inserting system prior to their assembly into a document and inserted into an envelope. The alignment of the parallel sheets is adjusted by commanding incremental position changes to servo drive motors used to control the position of the parallel sheets during their transport through a hold module of the inserting system.

17 Claims, 11 Drawing Sheets

(51) Int. Cl.
*B65H 29/52* (2006.01)
*B65H 43/02* (2006.01)

(52) U.S. Cl.
CPC ..... *B65H 2511/20* (2013.01); *B65H 2511/51* (2013.01); *B65H 2511/528* (2013.01); *B65H 2701/18263* (2013.01); *B65H 2801/66* (2013.01)

(56) References Cited

U.S. PATENT DOCUMENTS

| | | | |
|---|---|---|---|
| 6,443,447 | B1 | 9/2002 | Ifkovits et al. |
| 6,764,070 | B2 | 7/2004 | Masotta et al. |
| 7,752,948 | B2 | 7/2010 | Sussmeier et al. |

OTHER PUBLICATIONS

European intention to Grant for Application No. 14192784 dated Apr. 25, 2016.
European Intention to Grant for Application No. 14192784 dated Aug. 25, 2016.

* cited by examiner

TOS Module (108)
107
253
S2-1
252
S1-1
A-I
Cutter Module (104)
106

TOS Module (108)
107
253
S2-1
252
S1-1
A-I
Cutter Module (104)
106

TOS Module (108)
107
253
S2-1
252
S1-1
A-I
Cutter Module (104)
106

METHOD AND SYSTEM FOR SYNCHRONIZING ITEMS USING POSITION COMPENSATION

RELATED APPLICATIONS

This application claims the benefit of U.S. Provisional Application No. 61/903,734 entitled "METHOD AND SYSTEM FOR SYNCHRONIZING ITEMS USING POSITION COMPENSATION" filed on Nov. 13, 2013, the disclosure of which is entirely incorporated herein by reference.

TECHNICAL FIELD

The present subject matter relates to techniques and equipment to control the alignment of sheets of paper that are assembled into a document before the document is inserted into an envelope by mail processing equipment, such as an inserter system.

BACKGROUND

U.S. Pat. No. 6,443,447 B1, entitled "Method And Device For Moving Cut Sheets in a Sheet Accumulating System" and U.S. Pat. No. 7,752,948 B2, entitled "Method and Apparatus for Enhanced Cutter Throughput Using an Exit Motion Profile", both address sheet alignment by having a velocity motion profile. A first path's initial speed is greater than an adjacent second path until it is determined that it must be decelerated to the adjacent second path's speed to be delivered to the downstream module at the desired lead edge to lead edge distance/offset.

U.S. Pat. No. 6,764,070 B2, entitled "Path Length Compensation Method and Device for High Speed Sheet Cutters" addresses sheet alignment by increasing the path length at which one document must travel such that the lead edge to lead edge distance/offset is at the desired amount upon entering a Turnover Sequencer (TOS)/Right Angle Turn (RAT).

The existing technology does not address the requirement for positive control of both the left and right sheets' alignment being adjusted in position relative to each other. In addition, existing technology does not account for the initial alignment of the sheets as received from an upstream module.

Current sheet synchronization systems only adjust relative position of the side by side sheets to account for the path length difference that the sheets experience when traveling through the turnover sequencer (TOS). This synchronization is accomplished by using a different velocity motion profile for each sheet. The velocity profile must include an acceleration and deceleration rate that does not cause paper damage or slippage in the sheet drive. The steady state velocity must be maintained between the acceleration and deceleration period such that the total motion profile for each sheet produces the desired overlap of the sheets upon output from the TOS. The total motion profile is a complex command sequence. The total motion profile configuration only accounts for the TOS path length difference and cannot account for the amount of offset between the sheets that results from the cutting and advancement of the sheets out of the cutter.

Hence a need exists for measurement of the sheets initial alignment upon reception from an upstream module and for using separate servo motor position control for both the left and right sheets to employ a sequence of position control adjustments to each sheet during the sheet transition through the hold module.

SUMMARY

The teachings herein alleviate one or more of the above noted inserter problems with the use of a device such as photocells of a hold module to capture the angular displacement of servo motors for each parallel sheet transport which are configured to transport sheets as they exit a cutter module of an inserting system. These values are used to determine the initial alignment of the sheets. The alignment of the sheets is adjusted by commanding incremental position changes to the servo drives which control the position of the sheets during their transition through the hold module.

In certain aspects, there is provided a an inserting system configured to adjust alignment of a plurality of sheets of paper outputted from a cutter module. The inserter system includes a hold module positioned downstream from the cutter module. The hold module includes a plurality of parallel sheet transports for transporting the sheets of paper in parallel. A plurality of servo motors are configured to drive each sheet transport and each servo motor including an encoder configured to generate encoder pulses for each rotation of the servo motors. First and second photo sensors are configured to detect a presence of first and second sheets at respective sheet transport entry points. An inserter system control computer is programmed to calculate an alignment adjustment of the sheets in the hold module to account for requirements of one or more modules downstream of the hold module. The system control computer is configured to calculate an initial alignment offset between the sheets based on a difference in encoder pulses received between a first detection of the first sheet by the first photo sensor on a first sheet transport and a detection of the second sheet by the second photo sensor on a second sheet transport; receive established sheet alignment requirements of the one or more modules downstream of the hold module; calculate an alignment correction distance, and control a distance that each sheet in the hold module is to be moved for each cyclic update.

In certain other aspects, there is provided a method for aligning a plurality of sheets processed in parallel by an inserter system. The method includes transporting first and second sheets through parallel first and second transports of a hold module of the inserter system. Photocell triggers are received from first and second photocells, and encoder pulse values are received from first and second encoders that are positioned at the first and second transports in the hold module as the first and second sheets are transported through the hold module. An initial alignment offset is calculated by counting a number of encoder pulses received from the first encoder from a first time at which the first sheet triggers the first photocell until a second time at which the second sheet triggers the second photocell. An amount of alignment correction is divided equally between a first servo motor associated with the first transport path and a second servo motor associated with the second transport path based on requirements of one or more subsequent modules downstream from the hold module. The first servo motor is driven to adjust a first distance moved by the first sheet in the first transport path for each cyclic update, and the second servo motor is driven to adjust a second distance moved by the second sheet in the second transport path for each cyclic update. A total number of cyclic updates sent to each servo motor results in moving the first and second sheets through the hold module while imparting an offset distance between the first and second sheets.

The advantages and novel features are set forth in part in the description which follows, and in part will become apparent to those skilled in the art upon examination of the following and the accompanying drawings or may be learned by production or operation of the examples. The advantages of the present teachings may be realized and attained by practice or use of the methodologies, instrumentalities and combinations described herein.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

Figure 1:
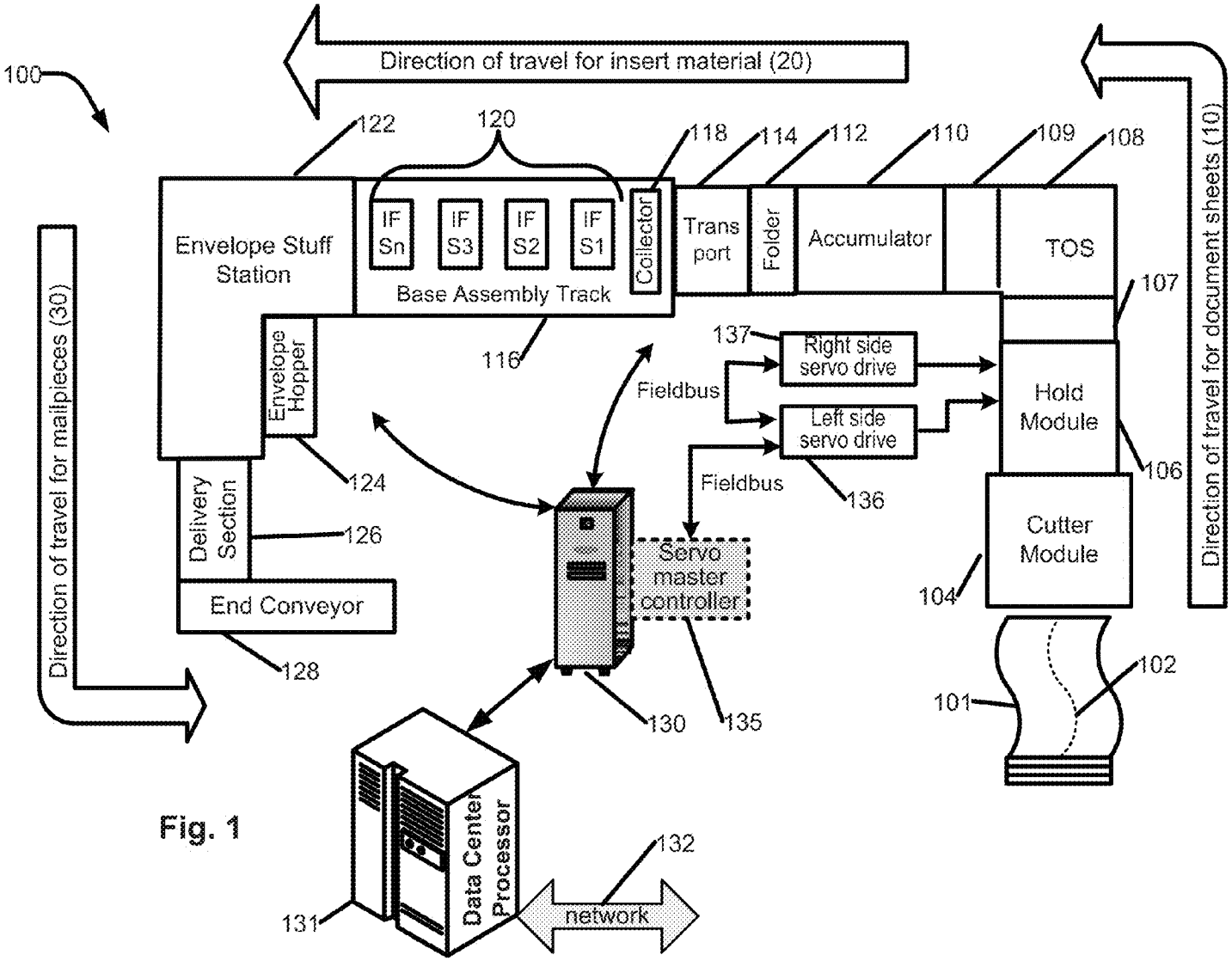
FIG. 1 is an exemplary block diagram of an inserter configured to process mailpieces.

In the following detailed description, numerous specific details are set forth by way of examples in order to provide a thorough understanding of the relevant teachings. However, it should be apparent to those skilled in the art that the present teachings may be practiced without such details. In other instances, well known methods, procedures, components, and circuitry have been described at a relatively high-level, without detail, in order to avoid unnecessarily obscuring aspects of the present teachings.

The description of the FIGS. 3 through 14 utilizes nomenclature to reference the numerous parameters associated with the position and distance traveled for the sheets of paper being processed in the hold module 106. Table 1 below is a cross-reference of the nomenclature used in the drawings to the definition of the parameter. The sheet processing associated with the hold module illustrates an exemplary process for aligning a left sheet S1 and a right sheet S2. The dash numbers 1 through 4 assigned to sheet references (S1 and S2) indicate the position in the process cycle in which the sheet is located. Multiple dash references for the same sheet (S1 or S2), which are used in the same figure, are for illustration of the process cycle where several process cycle steps are shown in one figure.

TABLE 1

| Nomenclature | |
|---|---|
| O-I | Initial overlap—The amount which the left and right sheet will overlap at the TOS exit if sheets are perfectly aligned at the TOS entry |
| O-D | Desired overlap—The desired amount for the left and right sheet to overlap at the TOS exit |
| A-I | Initial alignment—The distance parallel to the paper path between the left and right sheets lead edge upon reception from upstream module |
| A-F | Final alignment—The distance, parallel to the paper path, between the left and right sheet's lead edge prior to entering the TOS necessary to get the desired overlap (O-D) at the TOS exit |
| A-C | Alignment Correction—The amount to adjust the left and right sheet's alignment, given an initial alignment A-I, to get final alignment A-F prior to the TOS entry transport |
| D-C | The distance both hold module servo drives commanded position is incremented each cyclic fieldbus update to maintain constant velocity |
| N | The number of cyclic fieldbus updates which will occur during the time which it is possible for adjustment to occur. |
| D-A | The amount to change the constant velocity increment (D-C) of each servo drives commanded position during adjustment. |
| D-R | The distance the retarding sheet's servo drive commanded position is updated during adjustment per cyclic fieldbus update. |
| D-L | The distance the advancing sheet's servo drive commanded position is updated during adjustment per cyclic fieldbus update. |
| S1-1 | Left sheet position at hold module entry for a left hand TOS |
| S1-2 | Left sheet during alignment adjustment in hold module |
| S1-3 | Left sheet in TOS entry transport ready for entry into TOS |
| S1-4 | Left sheet position after exiting TOS |
| S2-1 | Right sheet position at Hold Module entry |
| S2-2 | Right sheet during alignment adjustment period in Hold Module |
| S2-3 | Right sheet in TOS entry transport ready for entry into TOS |
| S2-4 | Right sheet after exiting TOS |

Reference now is made in detail to the examples illustrated in the accompanying drawings and discussed below. FIG. 1 illustrates an exemplary block diagram for a mailpiece inserter system 100. The inserter system 100 assembles a mailpiece by accumulating sheets of a document, adding inserts, stuffing the document and inserts into an envelope and collecting the finished mailpieces for delivery to the postal authority. It is understood that inserter system 100 may be configured using alternative designs and still employ the technology disclosed herein. By way of example, inserter system 100 can be configured to include a right hand Turnover Sequence (TOS) and benefit from the disclosures herein. Inserter system 100 is configured to process 2-up sheets for creating a document, such as but not limited to a financial statement, invoice, advertisement, investment portfolio or prospectuses. The term 2-up refers to the roll of pre-printed paper or stack of pre-printed fan folded sheet paper 101 where two sheets are printed side by side on the roll of preprinted paper or on the stack of preprinted fan folded sheet paper 101. The dotted line 102 represents where the longitudinal first cut is performed whether the input paper is a roll or sheet. The dotted line represents a cut line and is not an indication that it is perforated. The horizontal cut performed by the cutter module 104 completes the separation of the two sheets from the roll or fan fold stack at which time they are transported to the hold module 106. Initially, before the horizontal cut, the two sheets are aligned exactly side by side, however due to the method employed to cut and transport the sheets to the hold module the cutter module 104 may output the two sheets with one leading or trailing the other. The hold module 106 measures this initial alignment and accounts for it in the process of adjusting the sheet alignment to be consistent with requirements of the downstream modules The sheet alignment process disclosed herein is applicable to processing larger width input paper, such as but not limited to, 3-up and 4-up configuration input paper configurations.

In the inserter system 100, the hold module 106 adjusts the sheets' alignment prior to entering the Turnover Sequencer (TOS) entry transport 107. The TOS entry transport 107 moves the two sheets from the hold module 106 into the TOS 108. The cut sheets of paper that make up the document move through the inserter in the direction indicated by arrow 10, as shown in FIG. 1.

Figure 2:
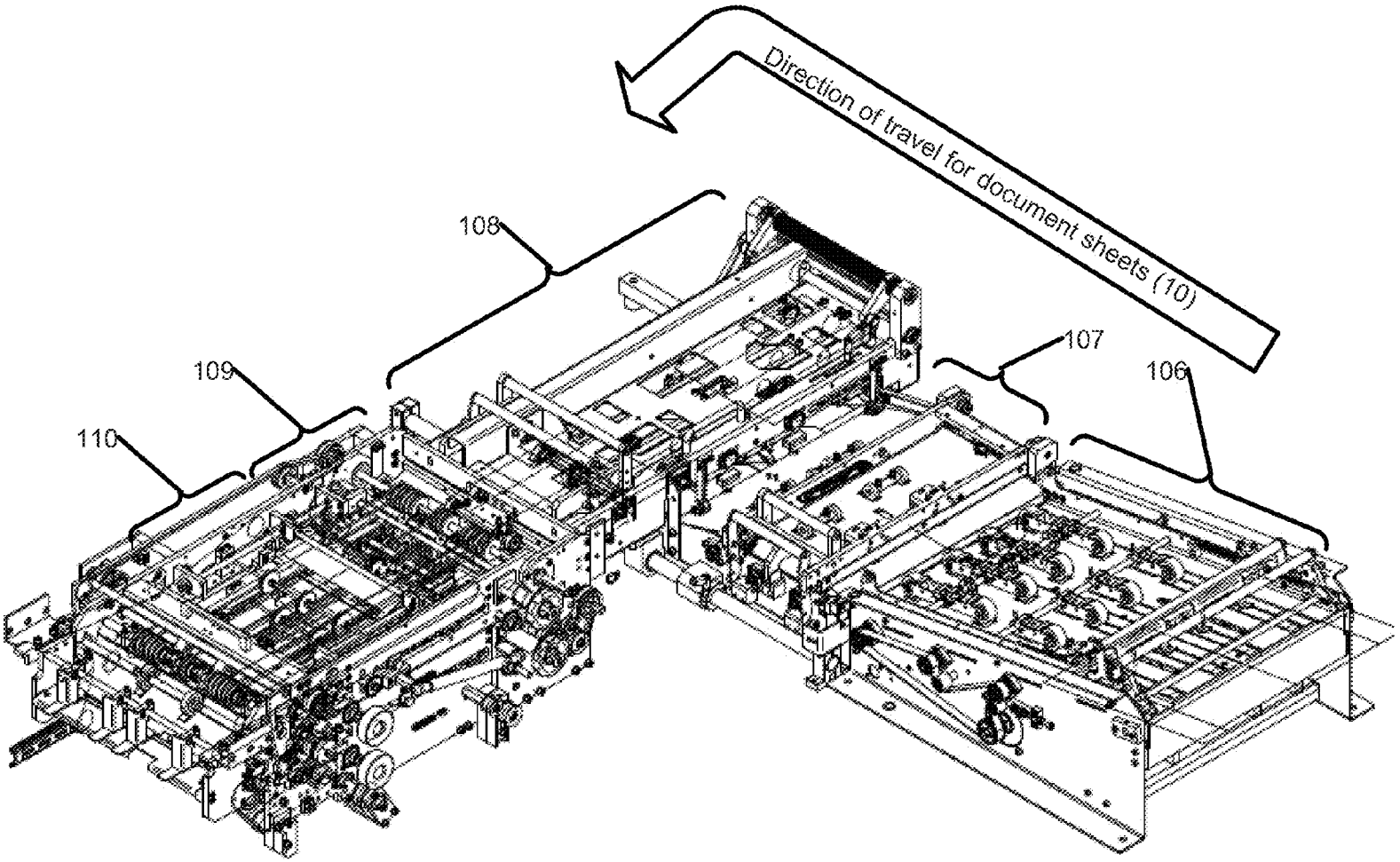
FIG. 2 is an exemplary isometric view of the inserter modules used to process multiple sheet documents.
Figure 3:
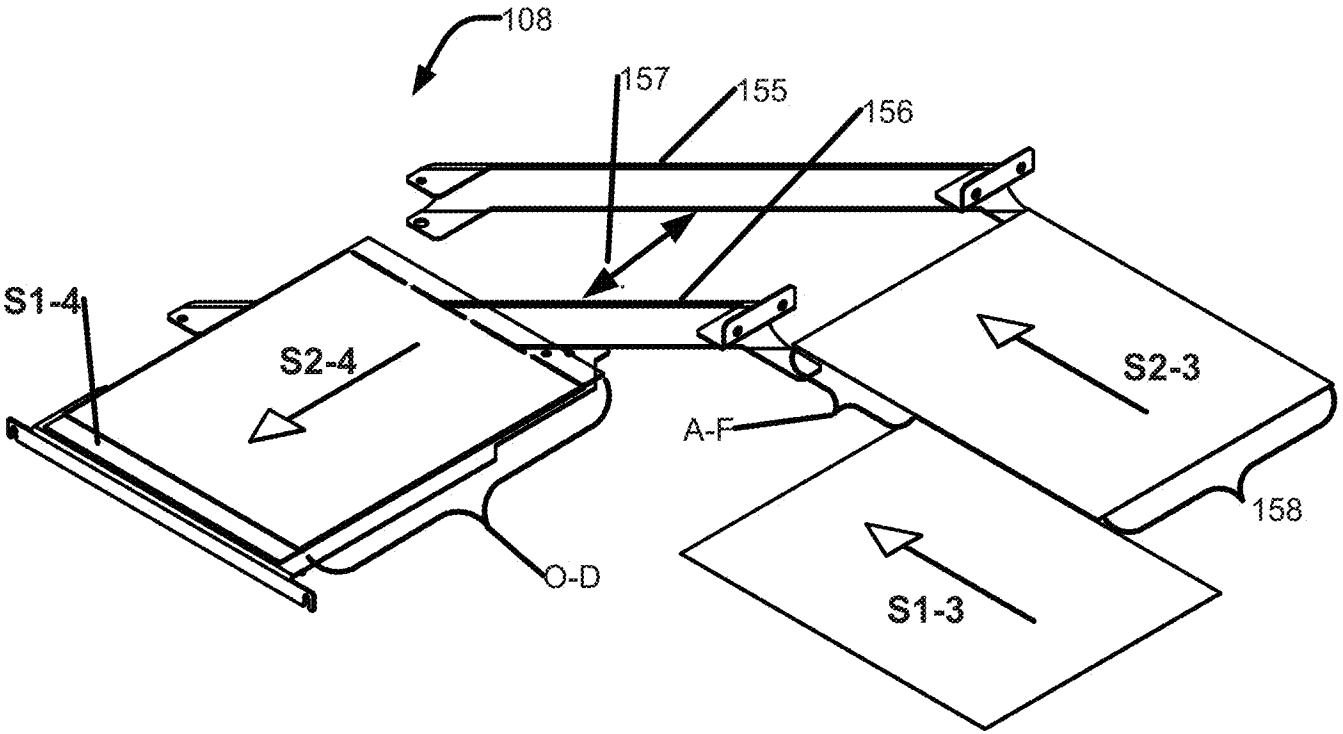
FIG. 3 is an exemplary isometric view of the turnover sequencer used to merge sheets of a document.

The TOS 108 (FIGS. 1, 2 and 3) merges sheets S1-3 and S2-3 (FIG. 3) which are entering the TOS from the TOS entry transport 107. The TOS illustrated in FIGS. 1, 2 and 3 is a left hand 90 degree turn module. As illustrated in FIG. 3, sheets S1-3 and S2-3 are in an offset position, when entering into the TOS 108, where the sheets enter the left 156 and right 155 open turnover tubes. These tubes are approximately one half open so that when sheets S1-3 and S2-3 are driven into the tubes they will curl on the inside surface. The curling action inverts each sheet and redirects them 90 degrees to the left in the direction of the TOS output transport 109. The TOS turnover tubes 156 and 155 are spaced apart by a distance 157 that corresponds to the width 158 of the sheet. This geometry makes the path length that sheet S2-3 travels longer than the path length for sheet S1-3 by a distance equal to the sheet width 158. Sheet S2-4 is on top of sheet S1-4 after they exit the TOS 108. In order to have the merged sheets S1-4 and S2-4 overlapped by distance (O-D), as required for downstream processes, they must enter the TOS with lead edge to lead edge offset by a distance (A-F). The hold module's design for adjusting the alignment of two side by side sheets, to obtain the desired overlap distance (O-D), is explained below with reference to FIGS. 9 through 14.

Referring back to FIGS. 1 and 2, the TOS output transport 109 moves the merged sheets S1-4 and S2-4 from the TOS 108 to the accumulator 110. The accumulator 110 collects all the sheets that form the pages of a document before passing the completed document to the folder 112. The folder 112 imparts the fold style required by the particular type of envelope used. The folder 112 may be bypassed if flat envelopes are used. The folder 112 outputs the document to the folder output transport 114 where the document is collected in the collector 118 at the input to the base assembly track 116. One or more insert feeders (IFS1 . . . IFSN) 120 are located on the base assembly track 116 to add inserts to the material as the material for the mailpiece is moved down the base assembly track. This material, document plus inserts, is inserted into an envelope by the envelope stuffing station 122. The required envelopes are drawn from the envelope hopper 124 as needed by the envelope stuffing station 122. Insert material moves in direction 20 in this section of the inserter 100. The completed envelope, mailpiece, is moved by the delivery section 126 to the end conveyor 128 where the mailpieces are collected for delivery to the postal authority. The stuffed envelopes are moved in direction 30. FIG. 2 is an isometric view of the inserter hold module 106 through the accumulator 110 which is an exemplary illustration of these integrated functions.

Figure 4A:
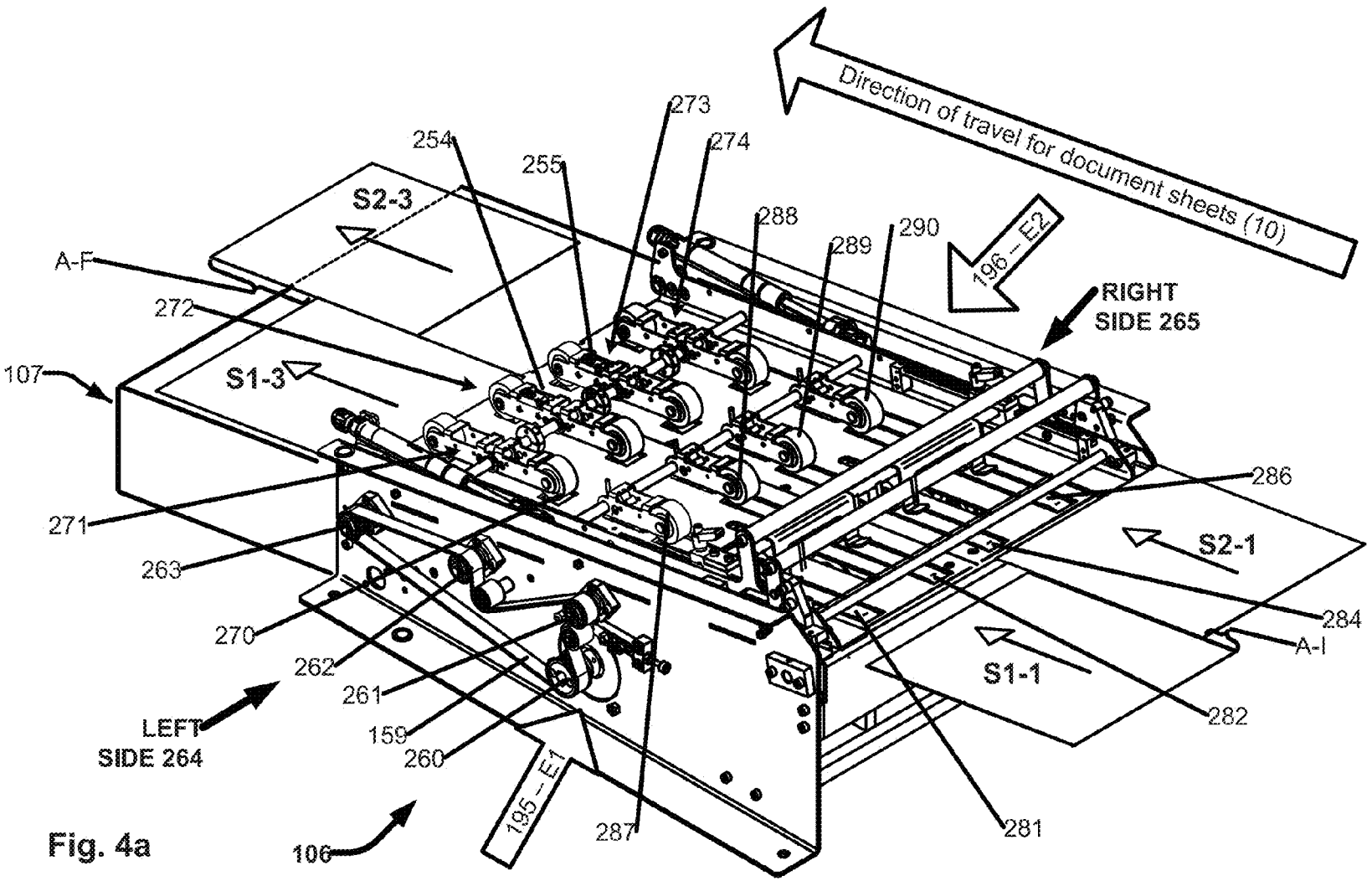
FIG. 4*a* is an exemplary isometric view of the hold module used to align sheets for processing in subsequent modules of an inserter.

The position control system of inserter system's 100 hold module 106 is controlled by an inserter control computer 130. Movement of the sheets of a document through the hold module 106 are controlled by the servo master controller 135, which is a software module executed in the inserter control computer 130. The servo master controller 135 communicates position instructions to the right and left side servo drivers 137 and 136 via a fieldbus connection (FIG. 1). The right and left side servo drivers 137 and 136 send the physical servo motor signals to the right and left servo motors 196 and 195 in the right side 265 and the left side 264 hold module transports, as shown in FIG. 4*a*. The software sheet position control requirements are defined in relationship to FIGS. 9 through 14. It should be understood that alternate computer processing and communication methods can be selected without impacting the performance of the hold module 106. Inserter job input parameters are received from the data center processor 131 and job results are sent by the computer 130 back to the data center processor 131. The data center processor 131 is network connected 132 to other inserters (not shown) and to other processing resources present in a document factory as may be required.

Figure 4B:
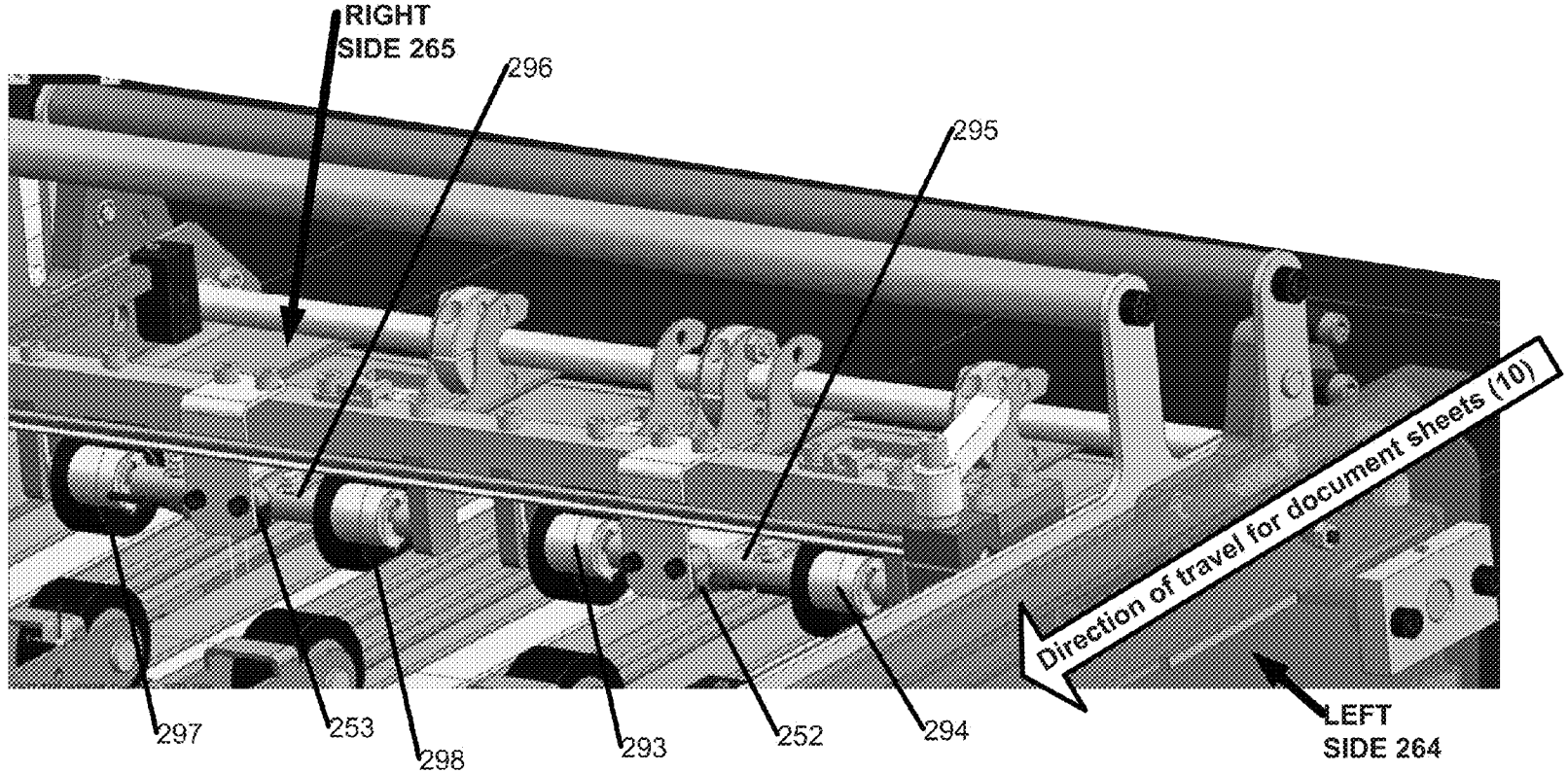
FIG. 4*b* is an exemplary isometric view of the hold module as viewed looking toward the input section from the output section.

Reference is now directed to FIG. 4*a* of an isometric view of the hold module 106. The hold module 106 includes two independently driven transports. The left side transport 264 includes two input bottom belts 281 and 282 that are driven by pulleys (not shown), which are mounted on shaft 261. Two idler roller assemblies 287 and 288 capture sheet S1-1 against bottom belts 281 and 282. As shown in FIG. 4*b* and viewed from the direction of travel 10, the left side transport 264 has an input roller assembly containing two additional idler rollers 293 and 294 on a single spring loaded shaft 295. Located on the shaft 295 is the sheet detection input photocell 252 for the left side transport 264. Belts 281 and 282 (FIG. 4*a*) form a nip between the belt and the roller assembly which captures sheet S1-1 and pulls the sheet into the transport. Similarly, the right side transport 265 has an input roller assembly containing two additional idler rollers, 297 and 298 on a single spring loaded shaft 296. Located on the shaft 296 is the sheet detection input photocell 253 for the right side transport 265. Belts 284 and 286 (FIG. 4*a*), form a nip between the belt and the roller assembly which captures sheet S2-1 and pulls the sheet into the transport.

A third set of idler assemblies 271 and 272 continue the positive transport control of sheet S1-1 through the hold module 106. The idler assembly 271 is driven by two rollers (input roller 270 and an output roller—not shown) attached to shafts 262 and 263. Idler rollers are mounted above the drive rollers to capture sheet S1-1 and transport the sheet without slippage. Idler assembly 272 is designed to be similar to idler assembly 271. The left side transport 264 is driven by servo motor 195 (not shown) that is connected to the primary drive pulley 260. The individual drive shafts 261, 262 and 263 are driven by a drive belt 159 that wraps around the primary drive pulley 260.

The right side transport 265 is driven independently from the left side transport 264 by servo motor 196 (not visible in FIG. 4a). All of the right side transport 265 components are the same as described for the left side transport 264. Shown in FIG. 4a are the bottom belts 284 and 286, two idler roller assemblies 289 and 290 and third set of idler assemblies 273 and 274. The right side transport 265 provides positive transport control of sheet S2-1 through the hold module 106.

The left and right servo motors 195 and 196 are located under left and right side transports 264 and 265 and therefore are not visible in FIG. 4a. The identification arrows 195 and 196 show the approximate position of the servos under the transports. Each servo motor 195 and 196 is driven by a right and left independent servo drives 137, 136 which are controlled by the servo master controller 135 software in the inserter control computer 130 (FIG. 1). Integrated in each servo motor 195 and 196 is a high precision incremental encoder E1 and E2 (FIG. 4a) which the servo drive uses to measure the motor's angular displacement. As an example, the encoders E1 and E2 have a resolution of about 1,048,576 counts per motor revolution and each motor revolution transports sheets S1-1 and S2-1 150 mm, via left and right side transports 264 and 265. This equates to about 6,990 encoder pulses per millimeter of travel. The servo master controller 135 utilizes this information to cyclically (i.e. a periodic rate) send each servo drive, 137 and 136, a commanded position to achieve the desired position change. The servo drive will then drive the servo motor to the commanded position before the next expected cyclic update. In the hold module 106, a new commanded position is sent to each servo drive at a 1 millisecond (ms) cycle. As an example, the velocity of the left and right side transports 264 and 265 is 5080 mm/sec or 200 in/sec when transporting sheets S1-1 and S1-2 into and out of the hold module 106. To achieve this velocity, the servo master controller 135 increments the commanded position by 35512 each cycle.

$$(D\text{-}C) = \frac{\text{Encoder_Counts_Per_Motor_Revolution}}{\text{MM_Per_Motor_Revolution}} \times \frac{\text{Velocity_MM_Per_Second}}{\text{Fieldbus_Updates_Per_Second}}$$

$$(D\text{-}C) = \frac{1{,}048{,}576}{150} \times \frac{5{,}080}{1{,}000}$$

$$(D\text{-}C) = 35{,}512$$

Sheets S1-1 and S2-1 enter the hold module 106 with an initial lead edge alignment A-I introduced by the cutter module 104. A-I can vary between each set of sheets due to slippage in the transfer from the cutter module 104 to the input rollers (293, 294; 297, 298) of the hold module 106. An incomplete cut may require the transport drive to rip the sheet from the cutter, causing a misalignment. Switching from roll to fan fold input paper also can effect alignment. Other reasons for misalignment out of the cutter can occur. However, the current disclosure can correct for the cutter alignment at the completion of every cut. The initial alignment may be a positive or negative. Once sheets S1-1 and S2-1 have been processed through the independent transports 264 and 265, the lead edge alignment A-F has been created between sheets S1-1 and S2-1 which is consistent with the requirements needed to process the sheets in subsequent modules of the inserter 100. The hold module's 106 method of measuring the initial alignment A-I and adjusting the alignment of sheets S1-1 and S2-1 to get alignment A-F is explained in reference to FIGS. 9 through 14.

Error detection is accomplished upon exiting the hold module 106 by comparing predicted time of arrival with the measured time of arrival of the left and right sheets S1-3 and S2-3 respectively, as measured by photocells 254 and 255, located within idler assemblies 272 and 273 respectively (FIG. 4a). If the measured and predicted time of arrival do not match within a tolerance, an error condition exists that indicates a jam may have occurred in the hold module 106 or the sheet alignment is faulty which may cause a jam in subsequent modules.

Figure 5:
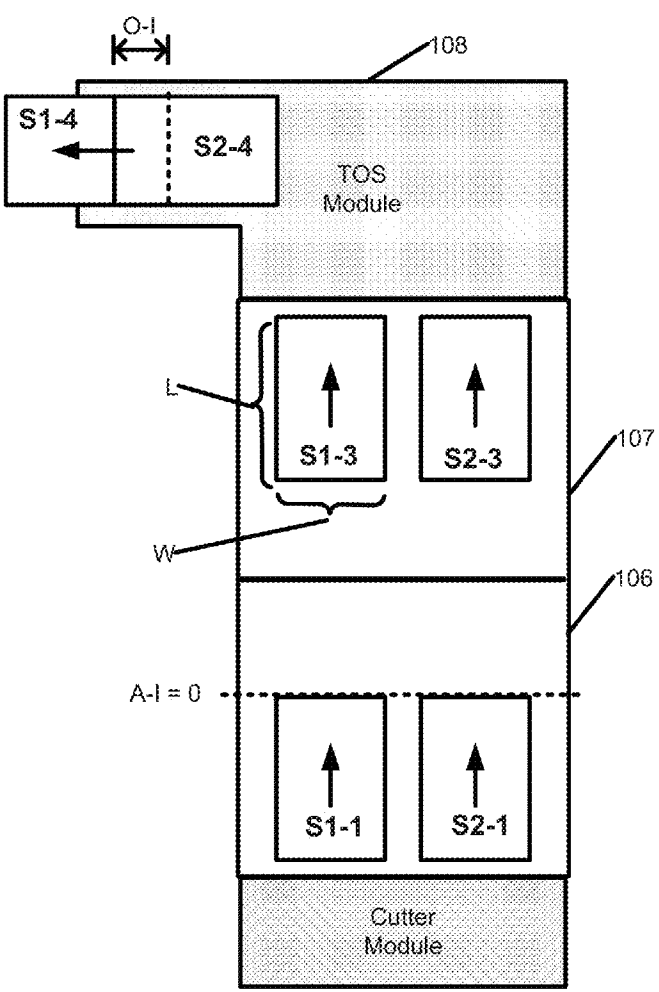
FIG. 5 is an exemplary diagram of the sheet positions as they move through the hold, TOS entry transport and TOS with zero initial alignment and without position adjustment.

Reference is now directed to FIGS. 5 through 8 for an explanation of how the desired overlap (O-D), for sheets S1-4 and S2-4, required at the TOS 108 exit, is a function of the upstream processes, referencing back to FIG. 4a and the hold module 106 components. FIG. 5 shows left and right sheets S1-1 and S2-1 entering the hold module 106 perfectly aligned (A-I=0). The hold module 106 does not perform any adjustment to the alignment while transporting them to the TOS entry transport 107. Sheets S1-3 and S2-3 remain perfectly aligned prior to entering the TOS 108. The sheets S1-4 and S2-4 then exit the TOS 108 overlapped (S2-4 is on top of S1-4) by distance O-I due to the path length difference through the TOS 108. The amount of overlap (O-I), which is seldom the overlap required by downstream inserter processes, is equal to the sheet length L minus the sheet width W.

$$(O\text{-}I)=L-W$$

Figure 6:
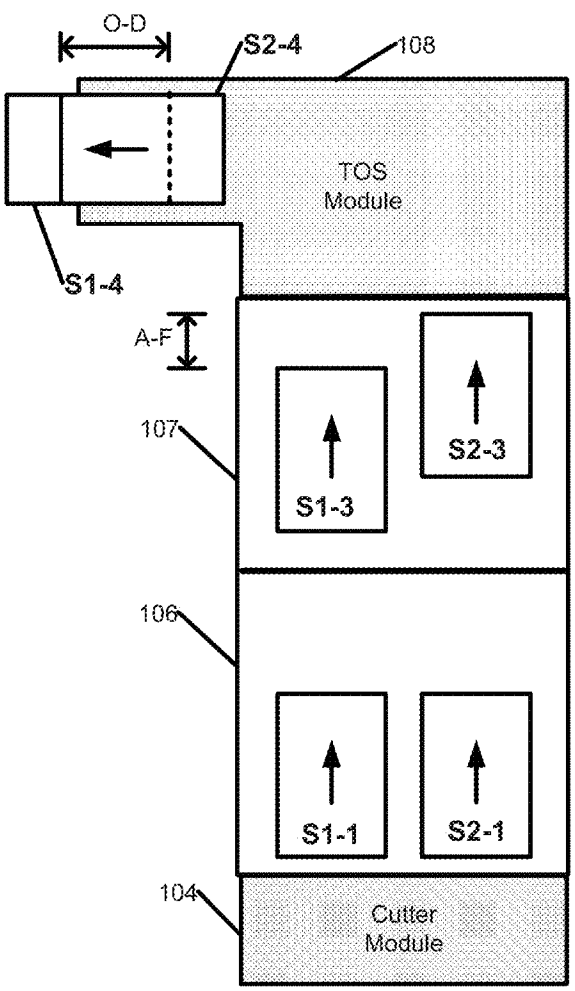
FIG. 6 is an exemplary diagram of the sheet positions as they move through the hold, TOS entry transport and TOS with zero initial alignment and position adjustment for TOS path length difference.

FIG. 6 illustrates the method employed by conventional systems to produce the desired overlap (O-D) of sheets S1-4 and S2-4 at the exit of the TOS 108. Same as FIG. 5, the left and right sheets S1-1 and S2-1 enter the hold module 106 perfectly aligned (A-I=0). Then, while being transported towards the TOS module (108), a method is employed to change the sheet's lead edge alignment to (A-F) prior to entering the TOS 108. This alignment accounts for the TOS module 108 geometry and produces the desired overlap O-D of sheets S1-4 and S2-4 at the TOS exit. For a predetermined desired overlap, required by downstream inserter processes, the necessary change to the sheets lead edge alignment can be calculated.

$$(A\text{-}F)=(O\text{-}D)-(O\text{-}I)$$

Figure 8:
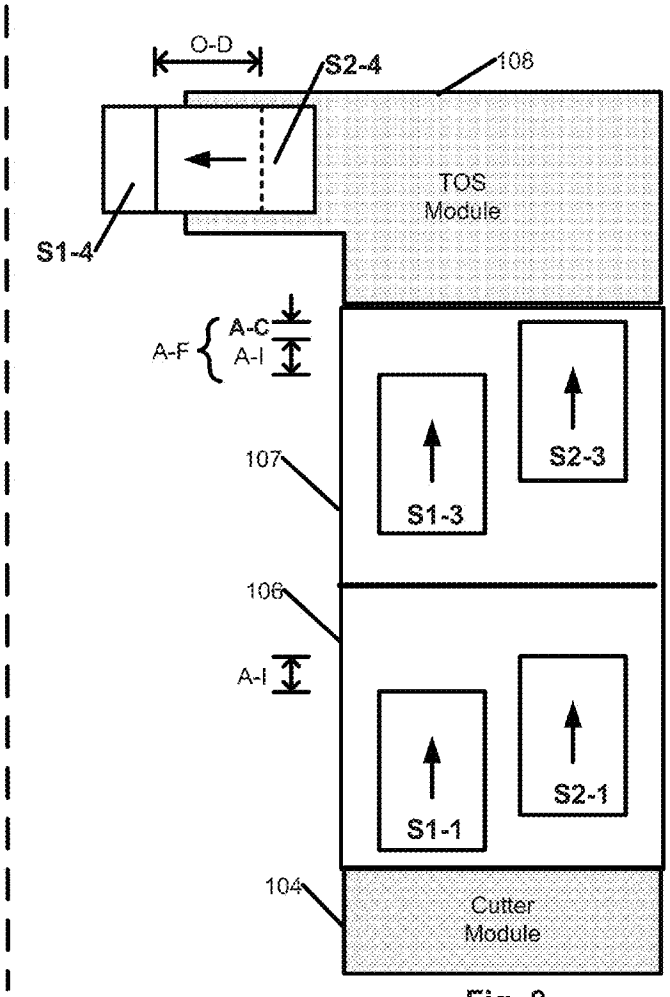
FIG. 8 is an exemplary diagram of the sheet positions as they move through the hold, TOS entry transport and TOS with position adjustment accounting for initial alignment and TOS path length.
Figure 7:
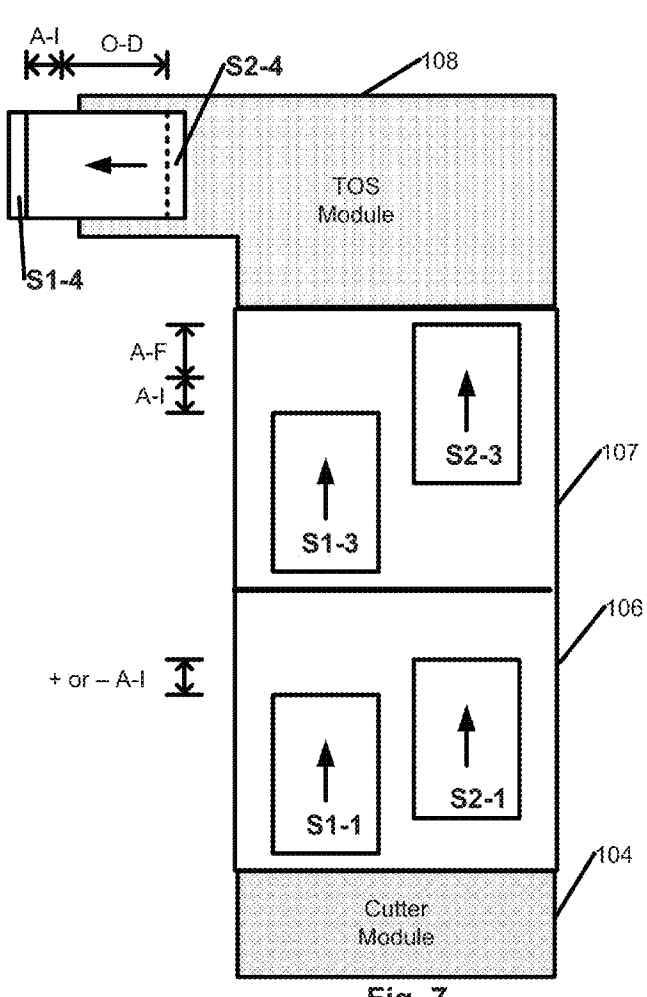
FIG. 7 is an exemplary diagram of the sheet positions as they move through the hold, TOS entry transport and TOS with initial alignment and position adjustment for TOS path length difference.

Missing from the methods employed in prior art is accounting for the initial alignment A-I that is typically non-zero difference. FIG. 7 illustrates again the method employed by conventional techniques, however with a non-zero initial alignment A-I. In this illustration, sheet S2-1 enters the hold module 106 ahead of sheet S1-1 by a distance A-I. As before, the method to change the sheet's lead edge alignment to A-F is employed however, due to the initial alignment, the sheets enter the TOS 108 with an alignment equal to A-F plus A-I. The overlap of sheets S1-4 and S2-4 at the TOS exit become the desired overlap (O-D) plus the initial alignment (A-I) and thus they are not correctly overlapped for downstream processes. Therefore, a method must be employed to measure the initial alignment (A-I) and account for it in the method employed to adjust the sheet's lead edge alignment to A-F prior to entering the TOS entry transport 107. This is illustrated in FIG. 8, where sheets S1-1 and S2-1 are received with initial alignment A-I. The hold module 106, knowing the initial alignment (A-I), the servo master controller 135, adjusts the alignment by A-C while transporting them to the TOS entry transport 107. The result is that the sheets S1-3 and S2-3 lead edge alignment, prior to entering the TOS 108, is equal to A-F which will result in the correct desired overlap O-D between sheets S1-4 and S2-4 at the exit of the TOS module 108.

Figures 9, 10, 11:
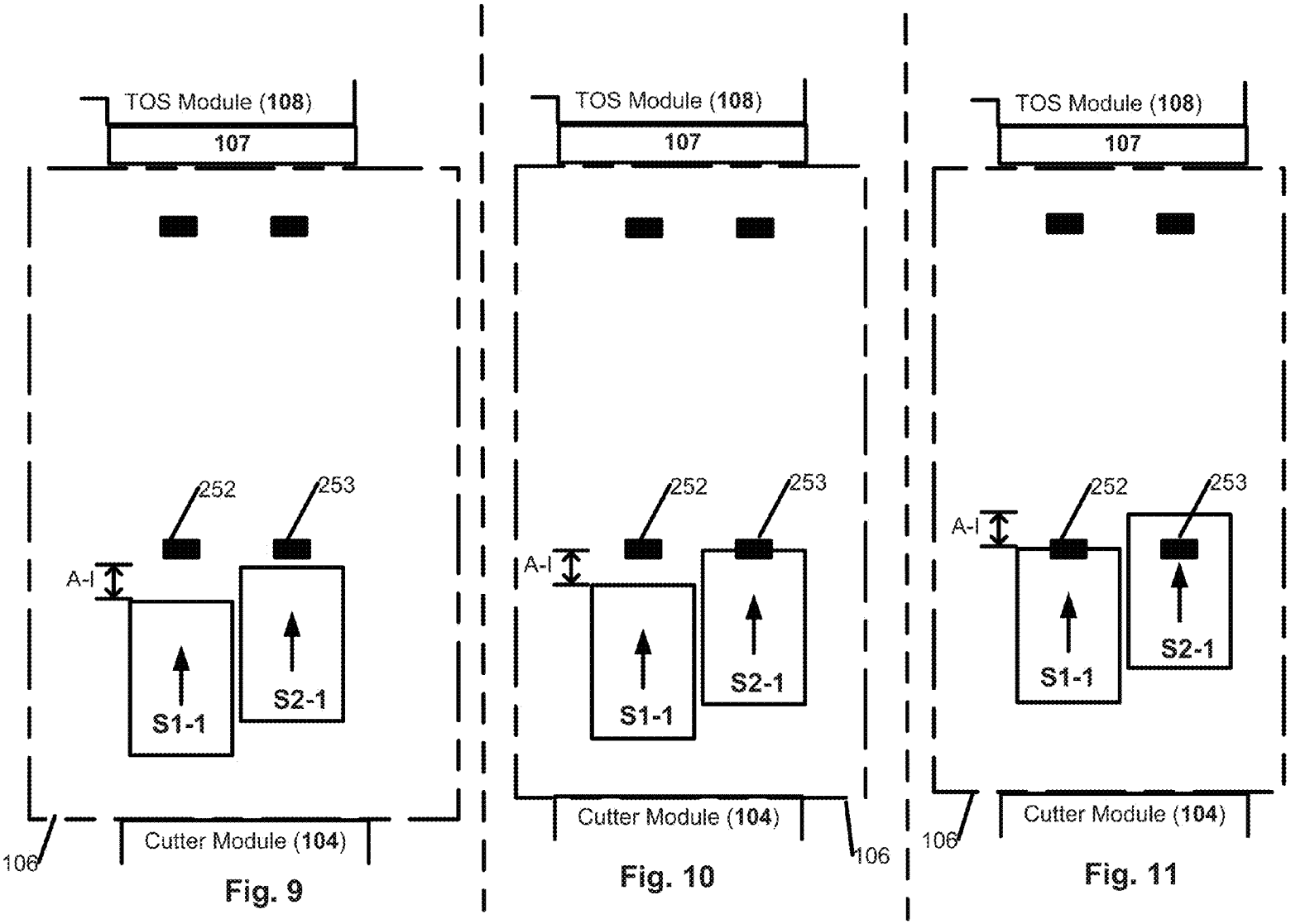
FIG. 9 is an exemplary diagram of the sheet positions with initial alignment due to the cutter as they approach hold module input photocells.
FIG. 10 is an exemplary diagram of the sheet positions as the right sheet reaches the right photocell.
FIG. 11 is an exemplary diagram of the sheet positions as the left sheet reaches the left photocell.
Figure 13:
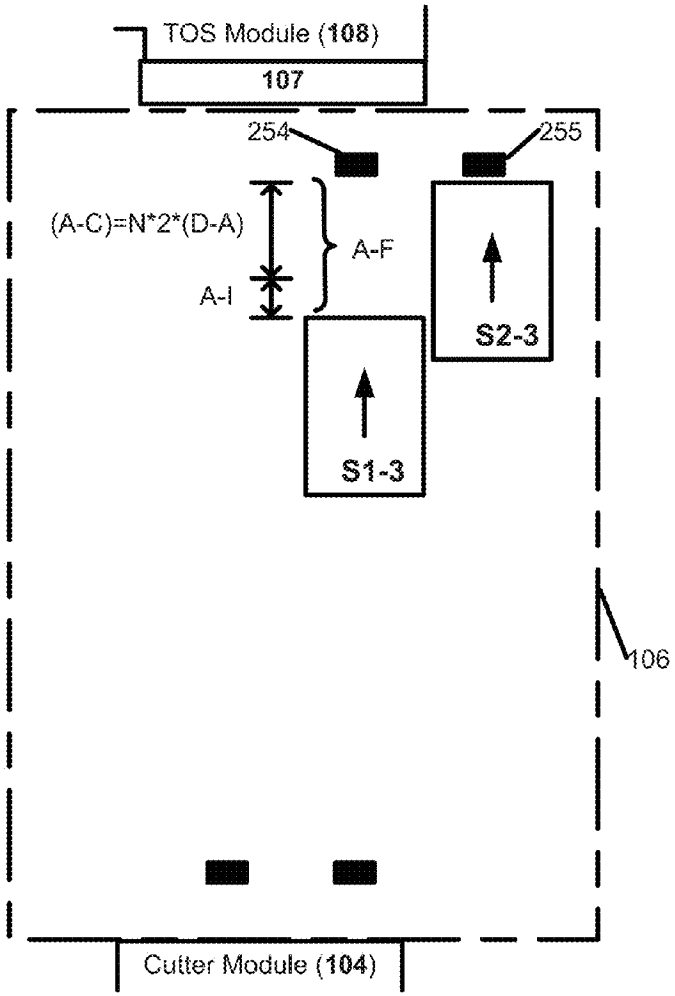
FIG. 13 is an exemplary diagram of the sheet positions after the hold position adjustments have been completed.

A unique feature of the hold module 106 of the present application is its ability to measure and account for the initial alignment in the method employed to adjust sheets S1-1 and S2-1 lead edge alignment prior to entering a TOS 108. FIG. 9 illustrates sheets S1-1 and S2-1, with initial alignment A-I, in the hold module 106 being transported at a constant and equal velocity towards photocells 252 and 253, respectively. As explained previously, the constant velocity of sheet S1-1 and S2-1 involves the servo master controller 135 cyclically sending the servo drives 136, 137 a commanded position which is incremented each cycle by D-C. To measure the initial alignment (A-I), the servo master controller 135 counts the number of encoder pulses received from encoder E2 from the time sheet S2-1 triggers photocell 253 until time sheet S1-1 triggers photocell 252 of servo motor 195 (E1). A-I is equal to the distance represented by each encoder pulse times the number of encoder pulses received between photocell triggers (FIGS. 10 and 11). A-I will be negative if the sheet S1-2 with the longer travel path (this case the sheet on the right hand side) is trailing sheet S1-1 upon entering the hold module 106.

By knowing the initial alignment (A-I), the alignment correction (A-C) can be accurately calculated so that the sheets enter the TOS module 108 with alignment (A-F), to obtain the desired overlap (O-D) exiting the TOS module 108.

$$(A\text{-}C)=(A\text{-}F)-(A\text{-}I)$$

At this point the servo master controller 135 is incrementing both servo drives' commanded position by D-C each cyclic update period, thus both sheet S1-1 and S2-1 are advanced downstream by the same amount each period. In operation of the present application, the positional control by the servo master controller 135 is utilized to adjust sheets' S1-1 and S1-2 alignment to achieve A-F prior to entering the TOS 108 by changing the amount by which the servo drive's commanded position is incremented. It is desirable to employ this technique so as to maintain smooth paper handling. The change to the servo drives commanded position incremental value should be minimized. In the hold module 106, this is done by first dividing the relative amount to adjust (A-C) between the two servo drives, retarding one drive by approximately one half A-C and advancing the other by approximately one half A-C. The error tolerance in the division of the alignment correction A-C between transports allows for variation in the one half of A-C value from being exactly equal to one half. Second, since it is known that the amount of time the sheets S1-1 and S2-1 are within the hold module 106 is greater than one cyclic update period, the adjustment of ½ A-C to each servo drive's commanded position is spread out over several updates. The number of cyclic updates (N) which adjustment is applied is calculated by dividing the time which it is possible to make this adjustment by the cyclic update period. The allowable time to perform an adjustment (e.g., 42 ms) in the hold module 106 is when sheets S1-2 and S2-2 are free of the cutter 104 and the TOS entry transport 107. The cyclic update period is, for example, 1 ms therefore N=42.

The result is that both servo drive's commanded position incremental value at steady state speed (D-C) is changed for N cyclic updates by:

$$(D\text{-}A)=(A\text{-}C)/2N$$

Figure 12:
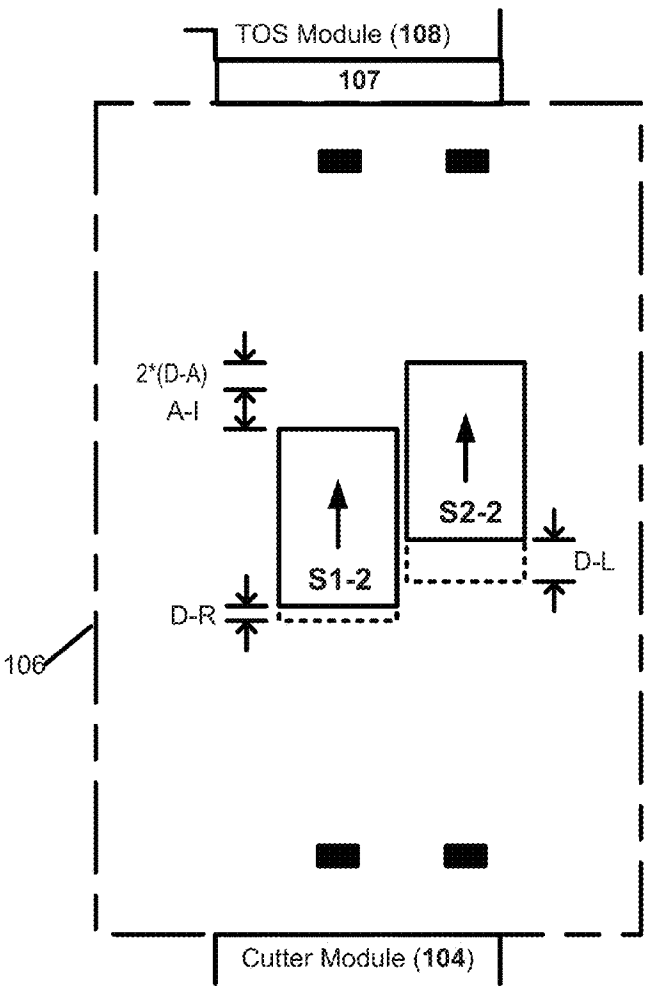
FIG. 12 is an exemplary diagram of the sheet positions as they transition through the hold and each sheet receives an incremental position adjustment.

Therefore, for N cyclic updates, the retarding servo drive's commanded position incremental value (D-R) will be equal to (D-C)−(D-A) and the advancing servo drive's commanded position incremental value (D-L) will be equal to (D-C)+(D-A). FIG. 12 illustrates the sheets position as they move through the hold module 106 and the change in alignment for the first update. The left side transport 264 moves sheet S1-2 forward by a distance of (D-R) and the right side transport moves sheet S2-2 forward by a distance of (D-L). Subtracting (D-L) from (D-R), shows that the net change in the sheets alignment for each cyclic update is 2 (D-A). Now referring to FIG. 13, after N updates the net alignment change is 2N*(D-A) which is equivalent to the necessary alignment correction (A-C) required, giving initial alignment (A-I), to achieve the final alignment (A-F) prior to the TOS 108 to get the desired overlap (O-D) at the output. The result is that the optimum sheet alignment is achieved without stressing the servo motors or subjecting the sheets to damaging accelerations that can cause jams, slippage and paper damage.

As implemented in the exemplary example, the D-A calculation involves returning an integer value however, in this case, if any remainder exists after the division then it is taken into account and handled with an additional fieldbus update. In addition, some of the word usage and such is in reference to a 90 degree left hand turn TOS module 108 configuration. All measurements and calculations work for other configurations, such as the Right Angle Turn (i.e. RAT) used conventionally, as well as initial alignments where sheet S1-1 is leading sheet S2-1.

Figure 14:
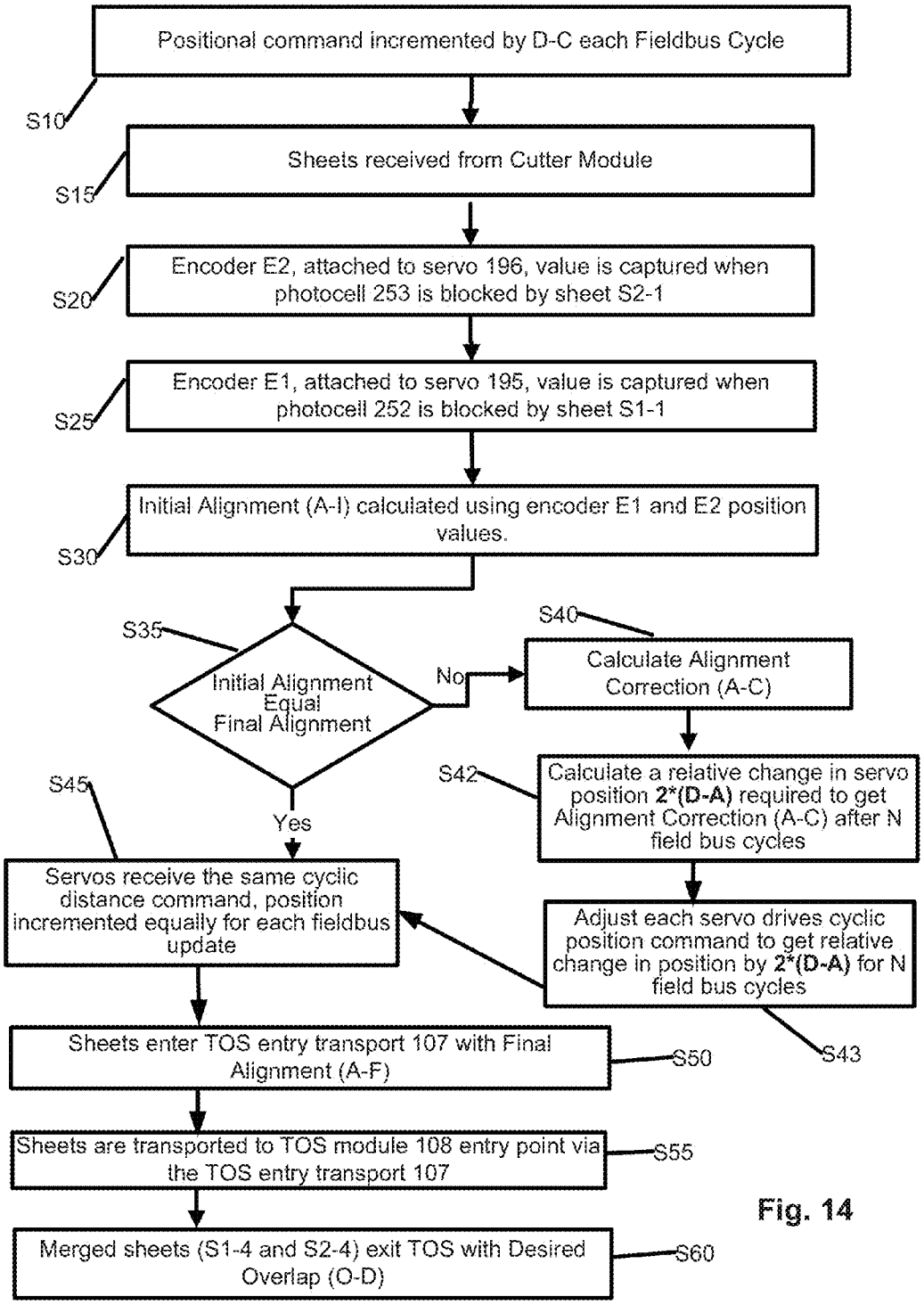
FIG. 14 is an exemplary process flow chart.

FIG. 14 is an exemplary process flow chart to illustrate the control steps for the hold module 106. The control process begins with both servo motors 195 and 196 advancing sheets S1-1 and S2-1 at a constant incremental distance (D-C) each fieldbus update (S10). Sheets S1-1 and S2-1 move from the cutter module 104 into the hold module 106 at a steady state speed as defined by (D-C) position updates (S15). Photocells 252 and 253 are used to trigger a read of the value of encoders E1 and E2 when sheets S1-1 and S2-1 block each photocell 252 and 253 respectively (S20 and S25). In step S30, the initial alignment (A-I) of sheets S1-1 and S2-1 is calculated based on the values of E1 and E2. In some rare cases, the initial alignment (A-I) equals the final alignment (A-F) (S35). When this occurs, there is no need to adjust the position update to produce additional offset between sheets S1-2 and S2-2. The servo master controller 135 sends, via cyclic fieldbus communication, the same position update (D-C) to each servo motor 195 and 196 (S45).

If (A-I) and (A-F) are not equal (S35), the alignment correction (A-C) is calculated (S40). With the (A-C) and (A-I) known, the relative change in servo position, per fieldbus command, 2*(D-A) required to achieve an Alignment Correction (A-C) after N field bus cycles may be calculated (step S42). After each servo motor has received N cyclic fieldbus position commands, an offset of (A-C) in position of sheets S1-3 and S2-3 is achieved (S43). The servo master controller 135 then sends (D-C) position updates to return sheets S1-2 and S2-2 to steady state speed prior to entering the TOS entry transport 107 (S45). The sheets S1-3 and S2-3 transfer to TOS entry transport 107 having alignment (A-F) (S50). Sheets S1-3 and S2-3 are transported from the exit of the hold module 106 to the TOS module 108 via the TOS entry transport 107 (S55). S1-4 and S2-4 are merged and overlapped by the desired overlap amount of (O-D) in the TOS module 108 (S60), and are ready for continued processing by the inserter system 100.

As shown by the above discussion, functions relating pertain to the operation of an inserting system wherein hold module control is implemented in the hardware and controlled by one or more computers operating as the control processor 130 connected the inserting system and to a data center processor/server 131 for data communication with the processing resources as shown in FIG. 1. Although special purpose devices may be used, such devices also may be implemented using one or more hardware platforms intended to represent a general class of data processing device commonly used to run "server" programming so as to implement the functions discussed above, albeit with an appropriate network connection for data communication.

As known in the data processing and communications arts, a general-purpose computer typically comprises a central processor or other processing device, an internal communication bus, various types of memory or storage media (RAM, ROM, EEPROM, cache memory, disk drives etc.) for code and data storage, and one or more network interface cards or ports for communication purposes. The software functionalities involve programming, including executable code as well as associated stored data. The software code is executable by the general-purpose computer that functions as the control processor 170 and/or the associated terminal device. In operation, the code is stored within the general-purpose computer platform. At other times, however, the software may be stored at other locations and/or transported for loading into the appropriate general-purpose computer system. Execution of such code by a processor of the computer platform enables the platform to implement the methodology for tracking of mail items through a postal authority network with reference to a specific mail target, in essentially the manner performed in the implementations discussed and illustrated herein.

Figure 15:
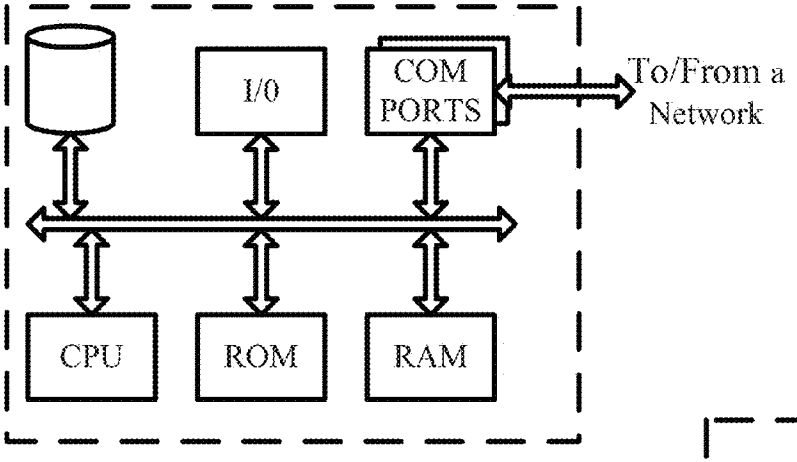
FIG. 15 illustrates a network or host computer platform, as may typically be used to implement a server.
Figure 16:
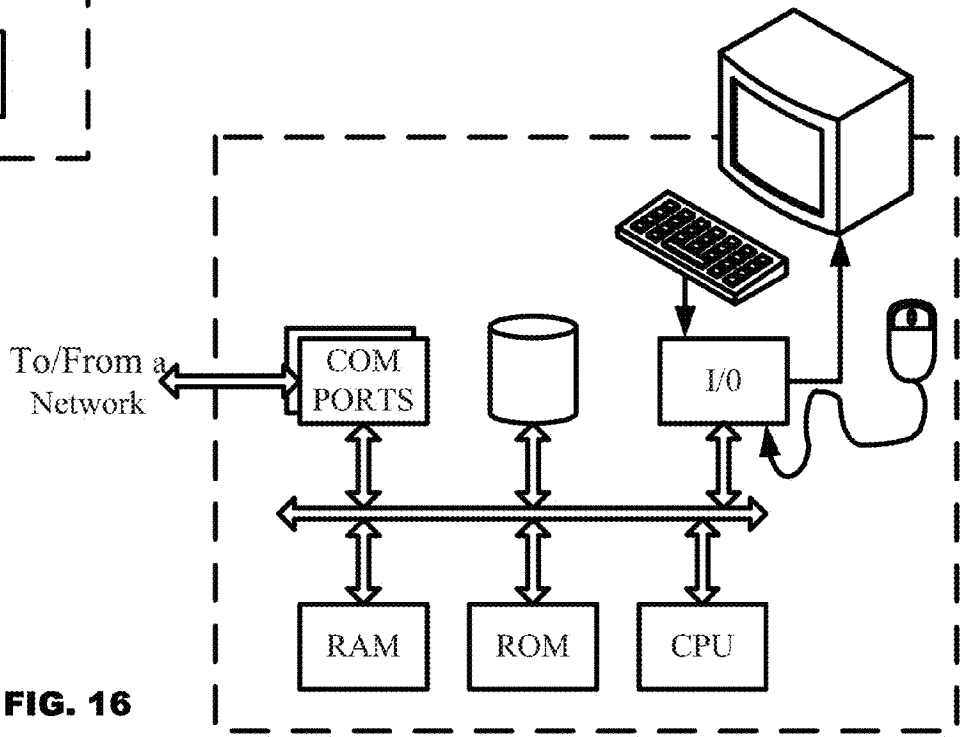
FIG. 16 depicts a computer with user interface elements, as may be used to implement a personal computer or other type of work station or terminal device.

FIGS. 15 and 16 provide functional block diagram illustrations of general purpose computer hardware platforms. FIG. 15 illustrates a network or host computer platform, as may typically be used to implement a server. FIG. 16 depicts a computer with user interface elements, as may be used to implement a personal computer or other type of work station or terminal device, although the computer of FIG. 16 may also act as a server if appropriately programmed. It is believed that those skilled in the art are familiar with the structure, programming and general operation of such computer equipment and, as a result, the drawings should be self-explanatory.

For example, control processor 130 may be a PC based implementation of a central control processing system like that of FIG. 16, or may be implemented on a platform configured as a central or host computer or server like that of FIG. 15. Such a system typically contains a central processing unit (CPU), memories and an interconnect bus. The CPU may contain a single microprocessor (e.g. a Pentium microprocessor), or it may contain a plurality of microprocessors for configuring the CPU as a multi-processor system. The memories include a main memory, such as a dynamic random access memory (DRAM) and cache, as well as a read only memory, such as a PROM, an EPROM, a FLASH-EPROM or the like. The system memories also include one or more mass storage devices such as various disk drives, tape drives, etc.

In operation, the main memory stores at least portions of instructions for execution by the CPU and data for processing in accord with the executed instructions, for example, as uploaded from mass storage. The mass storage may include one or more magnetic disk or tape drives or optical disk drives, for storing data and instructions for use by CPU. For example, at least one mass storage system in the form of a disk drive or tape drive, stores the operating system and various application software. The mass storage within the computer system may also include one or more drives for various portable media, such as a floppy disk, a compact disc read only memory (CD-ROM), or an integrated circuit non-volatile memory adapter (i.e. PC-MCIA adapter) to input and output data and code to and from the computer system.

The system also includes one or more input/output interfaces for communications, shown by way of example as an interface for data communications with one or more other processing systems. Although not shown, one or more such interfaces may enable communications via a network, e.g., to enable sending and receiving instructions electronically. The physical communication links may be optical, wired, or wireless.

The computer system may further include appropriate input/output ports for interconnection with a display and a keyboard serving as the respective user interface for the processor/controller. For example, a printer control computer in a document factory may include a graphics subsystem to drive the output display. The output display, for example, may include a cathode ray tube (CRT) display, or a liquid crystal display (LCD) or other type of display device. The input control devices for such an implementation of the system would include the keyboard for inputting alphanumeric and other key information. The input control devices for the system may further include a cursor control device (not shown), such as a mouse, a touchpad, a trackball, stylus, or cursor direction keys. The links of the peripherals to the system may be wired connections or use wireless communications.

The computer system runs a variety of applications programs and stores data, enabling one or more interactions via the user interface provided, and/or over a network to implement the desired processing, in this case, including those for tracking of mail items through a postal authority network with reference to a specific mail target, as discussed above.

The components contained in the computer system are those typically found in general purpose computer systems. Although summarized in the discussion above mainly as a PC type implementation, those skilled in the art will recognize that the class of applicable computer systems also encompasses systems used as host computers, servers, workstations, network terminals, and the like. In fact, these components are intended to represent a broad category of such computer components that are well known in the art. The present examples are not limited to any one network or computing infrastructure model—i.e., peer-to-peer, client server, distributed, etc.

Hence aspects of the techniques discussed herein encompass hardware and programmed equipment for controlling the relevant document processing as well as software programming, for controlling the relevant functions. A software or program product, which may be referred to as a "program article of manufacture" may take the form of code or executable instructions for causing a computer or other programmable equipment to perform the relevant data processing steps, where the code or instructions are carried by or otherwise embodied in a medium readable by a computer or other machine. Instructions or code for implementing such operations may be in the form of computer instruction in any form (e.g., source code, object code, interpreted code, etc.) stored in or carried by any readable medium.

Such a program article or product therefore takes the form of executable code and/or associated data that is carried on or embodied in a type of machine readable medium. "Storage" type media include any or all of the memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the relevant software from one computer or processor into another, for example, from a management server or host computer into the image processor and comparator. Thus, another type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, unless restricted to non-transitory, tangible "storage" media, terms such as computer or machine "readable medium" refer to any medium that participates in providing instructions to a processor for execution.

Hence, a machine readable medium may take many forms, including but not limited to, a tangible storage medium, a carrier wave medium or physical transmission medium. Non-volatile storage media include, for example, optical or magnetic disks, such as any of the storage devices in any computer(s) or the like. Volatile storage media include dynamic memory, such as main memory of such a computer platform. Tangible transmission media include coaxial cables; copper wire and fiber optics, including the wires that comprise a bus within a computer system. Carrier-wave transmission media can take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a PROM and EPROM, a FLASH-EPROM, any other memory chip or cartridge, a carrier wave transporting data or instructions, cables or links transporting such a carrier wave, or any other medium from which a computer can read programming code and/or data. Many of these forms of computer readable media may be involved in carrying one or more sequences of one or more instructions to a processor for execution.

In the detailed description above, numerous specific details are set forth by way of examples in order to provide a thorough understanding of the relevant teachings. However, it should be apparent to those skilled in the art that the present teachings may be practiced without such details. In other instances, well known methods, procedures, components, and software have been described at a relatively high-level, without detail, in order to avoid unnecessarily obscuring aspects of the present teachings.

What is claimed:

1. An inserting system configured to adjust alignment of a plurality of sheets of paper outputted from a cutter module, the inserting system comprising:

a hold module positioned downstream from the cutter module, the hold module including:

a plurality of parallel sheet transports for transporting the sheets of paper in parallel;

a plurality of servo motors configured to drive each sheet transport and each servo motor coupled to an encoder configured to generate encoder pulses for each rotation of the servo motors;

first and second photo sensors configured to detect a presence of first and second sheets at respective sheet transport entry points; and an inserter system control computer programmed to calculate an alignment adjustment of the sheets in the hold module to account for requirements of one or more modules downstream of the hold module, the system control computer configured to:

calculate an initial alignment offset between the sheets based on a difference in encoder pulses received between a first detection of the first sheet by the first photo sensor on a first sheet transport and a detection of the second sheet by the second photo sensor on a second sheet transport, receive established sheet alignment requirements of the one or more modules downstream of the hold module, calculate an alignment correction distance, and control a distance that each sheet in the hold module is to be moved for each cyclic update.

2. The inserting system of claim 1, wherein the first and second sheet transports are separately driven by first and second servo motors respectively.

3. The inserting system of claim 1, further comprising:

a servo master controller associated with the inserter system control computer, the servo master controller is configured to send a different position update to each of the first and second sheet transports for each cyclic update.

4. The inserting system of claim 3, wherein sheet position commands from the servo master controller for the first or second sheet transport feeding a downstream module with a path length longer than a path length of another downstream module is greater than a cyclic position update for a steady state transport position update prior to entering the one or more modules downstream of the hold module.

5. The inserting system of claim 3, wherein sheet position commands from the servo master controller for the first or second sheet transport feeding a downstream module with a path length shorter than a path length of another downstream module is less than a cyclic position update for a steady state transport position update prior to entering the one or more modules downstream of the hold module.

6. The inserting system of claim 1, wherein the one or more modules downstream of the hold module include: an accumulator, folder, or turnover sequencer.

7. The inserting system of claim 6, wherein the calculated alignment correction distance is divided between the first and second sheet transports prior to the first and second sheets entering the one or more modules downstream of the hold module.

8. The inserting system of claim 7, wherein the calculated alignment correction distance is divided equally between first and second servo motors of the plurality of servo motors, such that the first servo motor is retarded by approximately one half and the second servo motor is advanced by approximately one half.

9. The inserting system of claim 1, wherein the alignment correction distance necessary to obtain a final alignment offset required by the one or more modules downstream of the hold module is a function of: an initial measured alignment offset at an input to the hold module and an offset required by the one or more modules downstream of the hold module.

10. The inserting system of claim 1, wherein a number of cyclic updates over which the calculated alignment correction distance is applied is calculated by dividing a time by which it is possible to make the correction by the cyclic update period.

11. A method for aligning a plurality of sheets processed in parallel by an inserter system, the method comprising steps of:

transporting first and second sheets through parallel first and second sheet transports of a hold module of the inserter system;

receiving photocell triggers from first and second photocells, and encoder pulse values from first and second encoders positioned at the first and second sheet transports in the hold module as the first and second sheets are transported through the hold module;

calculating an initial alignment offset by counting a number of encoder pulses received from the first encoder from a first time at which the first sheet triggers the first photocell until a second time at which the second sheet triggers the second photocell;

dividing an amount of alignment correction between a first servo motor associated with the first sheet transport and a second servo motor associated with the second sheet transport based on requirements of one or more subsequent modules downstream from the hold module; and driving the first servo motor to adjust a first distance moved by the first sheet in the first sheet transport for each cyclic update, and driving the second servo motor to adjust a second distance moved by the second sheet in the second sheet transport for each cyclic update, wherein a total number of cyclic updates sent to each servo motor results in moving the first and second sheets through the hold module while imparting an offset distance between the first and second sheets.

12. The method according to claim 11, wherein the driving of the first and second servo motors imparts a sheet offset required by one or more modules downstream of the hold module, which include: an accumulator, folder, or turnover sequencer.

13. The method according to claim 11, wherein:

each cyclic update includes transport servo motor position commands sent from a servo master controller for the first or second sheet transport, and the position commands for the sheet transport that contains the sheet that trails in a final offset are less than the cyclic position commands for a steady state.

14. The method according to claim 11, wherein transport servo motor position commands are sent from a servo master controller for the first or second sheet transport, and the cyclic position commands for the sheet transport that contains a sheet that leads in a final offset are greater than the cyclic position commands for a steady state.

15. The method according to claim 11, wherein the alignment correction sent to the first and second servo motors is divided equally between the first and second servo motors, such that the first servo motor is retarded by approximately one half and the second servo motor is advanced by approximately one half.

16. The method according to claim 11, wherein a total position update, associated with the alignment correction sent to the servo motor drives for the first and second transport servo motors, is divided by a number of cyclic position updates that occur while imparting an offset distance between the first and second sheets.

17. The method according to claim 11, wherein the calculated offset between the first and second sheet imparted by the hold module is a function of the requirements of the one or more modules downstream of the hold module, which include: an accumulator, folder, or turnover sequencer.

* * * * *